United States Patent [19]

Anderson et al.

[11] 4,297,771

[45] Nov. 3, 1981

[54] PIVOTING FOOT CLAMP AND MOUNTING FRAME

[75] Inventors: Ronald B. Anderson, Plymouth; Clifford Caneer, Jr., Anoka; Terrance C. Maki, Coon Rapids, all of Minn.

[73] Assignee: Longyear Company, Minneapolis, Minn.

[21] Appl. No.: 48,488

[22] Filed: Jun. 14, 1979

[51] Int. Cl.[3] ..... A44B 21/00; E21B 19/07

[52] U.S. Cl. ..... 24/263 DA; 173/166; 173/167; 294/102 A

[58] Field of Search ..... 24/263 DA, 263 D, 263 DB, 24/263 DH, 263 DC, 249 DP, 263 DN, 263 DP; 294/102 A; 173/164, 166, 167, 165

[56] References Cited

U.S. PATENT DOCUMENTS

| | | | |
|---|---|---|---|
| Re. 23,842 | 6/1954 | Moore | 173/166 |
| 1,860,062 | 5/1932 | Taylor | 24/263 DA |
| 2,491,711 | 12/1949 | Calhoun | 173/166 |
| 2,581,362 | 1/1952 | Craine, Sr. | 173/165 |
| 2,700,201 | 1/1955 | Bannister | 294/102 A |

*Primary Examiner*—Roy D. Frazier
*Assistant Examiner*—Alexander Grosz
*Attorney, Agent, or Firm*—Clayton R. Johnson

[57] ABSTRACT

For clampingly holding a drill rod or the like, clamp apparatus that includes a mounting frame having spaced side members, a jaws holder having upwardly diverging end walls and bounding an opening for clamp jaws, longitudinally spaced jaw actuators that include piston cylinder combination having cylinders pivotally mounted on the jaw holder, and piston rods for moving jaw brackets upwardly and outwardly of one another, each bracket having an inclined leg extending into the jaw opening in slidable relationship with the adjacent end wall and into slots in the holder side walls, and side walls that have interleaving portions that maintain the brackets at substantially the same elevation relative one another while permitting the brackets moving longitudinally toward and away from one another, and a pin for releasably mounting each jaw to the respective bracket in abutting relationship to the adjacent bracket leg to move therewith, the jaws having semi-circular rod receiving recesses, the holder having oppositely disposed trunnions pivotally mounted by the side frame members, and legs pivotally mounted by the trunnions for mounting other mechanism and an adjustable connection for selectively retaining at least one of the legs in selected pivoted positions relative the frame.

12 Claims, 7 Drawing Figures

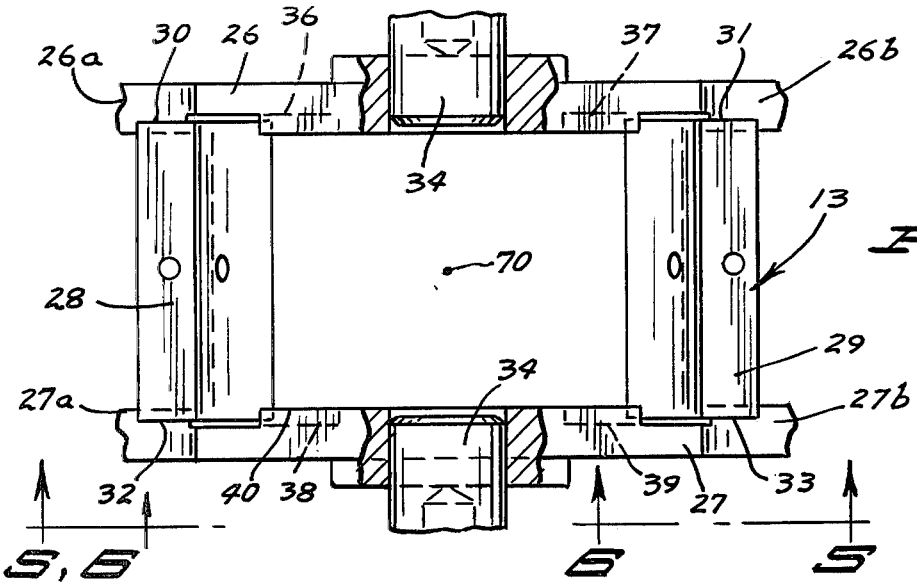
FIG. 4
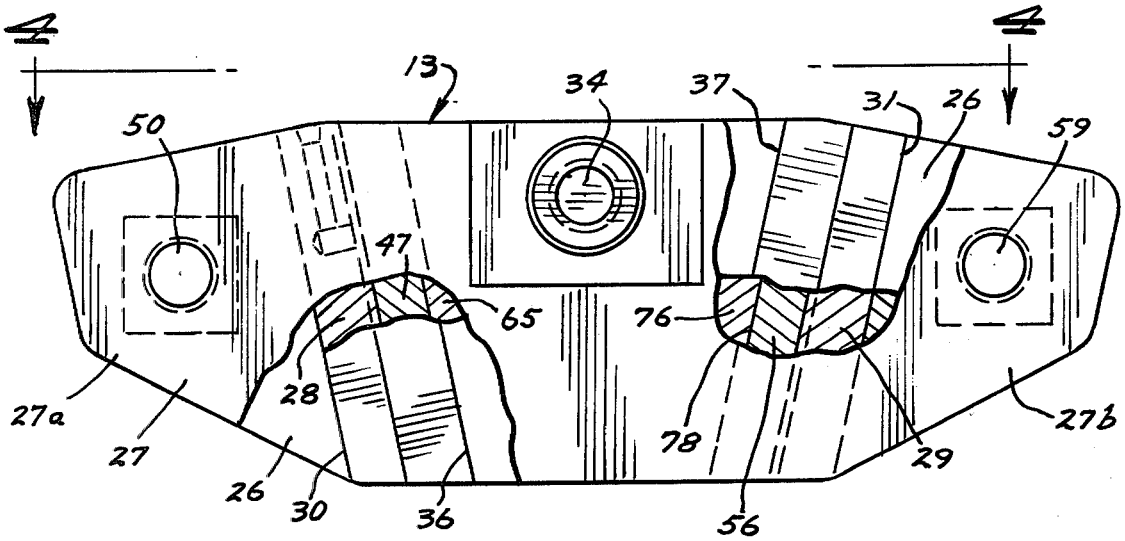
FIG. 5
FIG. 6
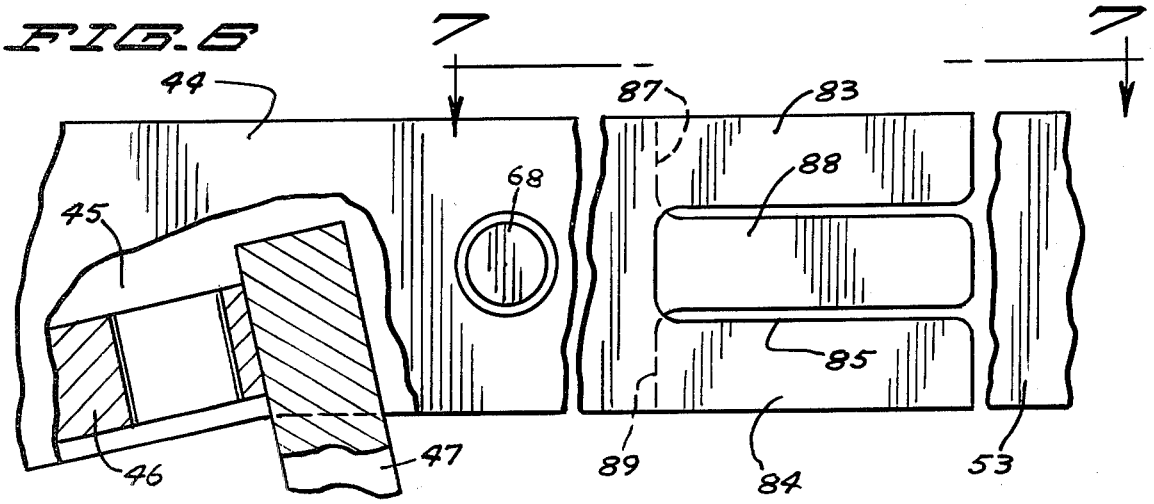

PIVOTING FOOT CLAMP AND MOUNTING FRAME

BACKGROUND OF THE INVENTION

Power actuated clamp apparatus for clampingly holding a drill rod or the like.

In the prior art it is known to provide power actuated clamp apparatus. For example, see U.S. Pat. No. 2,623,257 which discloses a pair of inclined cylinders for moving piston rods that through arms and shackels move a pair of jaws to a rod release position; U.S. Pat. No. 1,860,062 which discloses interlocked jaws; and U.S. Pat. No. 2,545,627. U.S. Pat. No. 1,883,073 discloses drill rod clamp apparatus that includes a bushing having opposite upwardly diverging walls that in part bound a space into which a pair of jaws extend, and generally truncated wedge shaped jaws having generally semi-cylindrical recesses opening toward the other.

Also existing clamping devices currently being used in the core drilling industry do not pivot about a horizontally mounted base, but rather require a tilted base platform when drilling angle holes.

In order to provide a clamping device that will withstand vertical, as well as torsional load for purpose of making and breaking threaded rod joints, and that is capable of being mounted on a horizontal or inclined surface and tilted to be aligned with the direction of the hole being drilled, this invention has been made.

SUMMARY OF THE INVENTION

Clamp apparatus for clamping holding a drill rod or the like that includes a base, a pair of jaws for grippingly engaging the drill rod, a jaw holder having an opening into which the jaws extend, a pair of power operated jaw actuators mounted on the holder and connected to the jaws for moving the jaws between a rod release position and a rod clamping position, and trunnions on the jaw holder for mounting the jaw holder on the base for pivotal movement about an axis that is generally perpendicular to the central axis of a rod clamped by the jaws.

One of the objects of this invention is to provide a new and novel mounting of clamp apparatus that permits easy alignment for vertical and angle holding drilling. Another object of the invention is to provide new and novel means for mounting clamp jaws and jaw actuating cylinders for reducing bending and fatigue in the jaws and the piston rods of the cylinders. A different object of the invention is to provide new and novel hydraulically actuated jaw mechanism operated under power between a rod release position, and a rod clamping position that is capable of holding both an axial and a torque load. Another object of the invention is to provide new and novel interlocking jaw apparatus to maintain the proper position of one jaw actuating cylinder relative the other while the jaw apparatus is operated between a rod release and a rod clamping position. An additional object of this invention is to provide a new and novel jaw holder having slotted guides and cooperating mechanism to retain the jaws in proper positions during use.

BRIEF DESCRIPTION OF DRAWINGS

FIG. 4 is a fragmentary plan view of the jaw housing, said view being generally taken along the line and in the direction of the arrows 4—4 of FIG. 5 other than portions of the housing side walls are broken away to show the trunnions;

FIG. 5 is a side view taken along the line and in the direction of the arrows 5—5 of FIG. 4, portions being broken away in different transverse positions to show the mounting of parts of the jaw actuators and the jaw assemblies;

FIG. 6 is a fragmentary side view of the jaw actuators to more clearly show the jaw actuator interlocks, portions of the view being broken away to show details of the jaw actuator.

Figure 1:
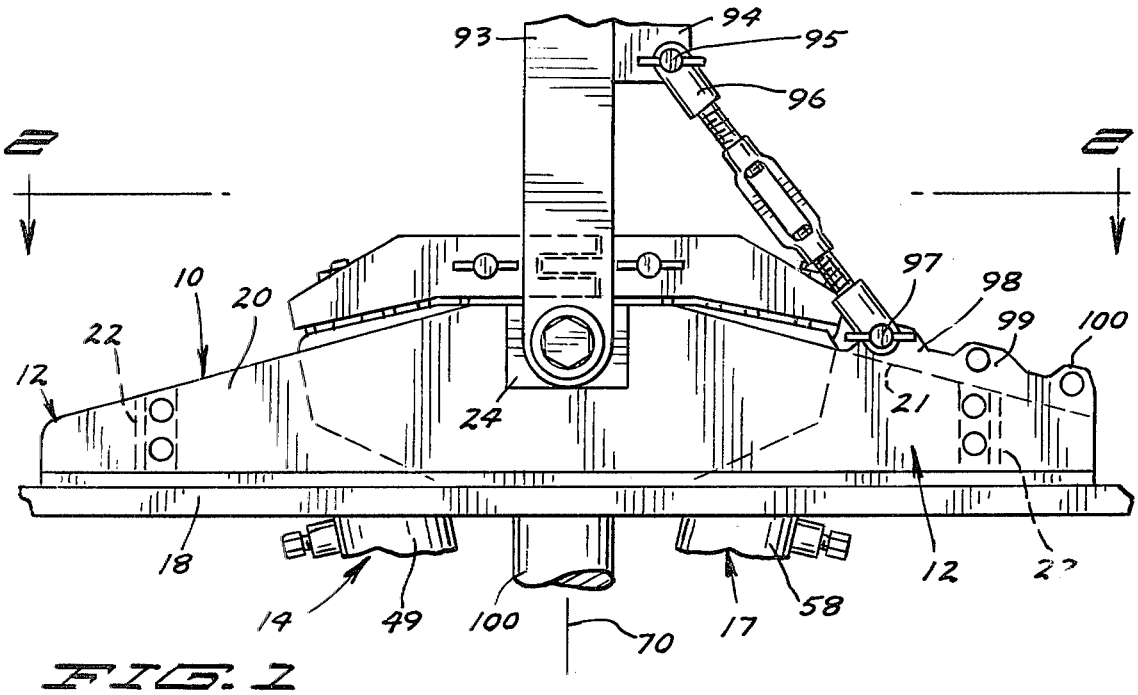
FIG. 1 is a side view of the apparatus of this invention that is generally taken along the line and in the direction of the arrows 1—1 of FIG. 2, said view showing only a portion of the platform on which the apparatus is mounted, a portion of the cylinders and an arm for mounting other mechanism.
Figure 3:
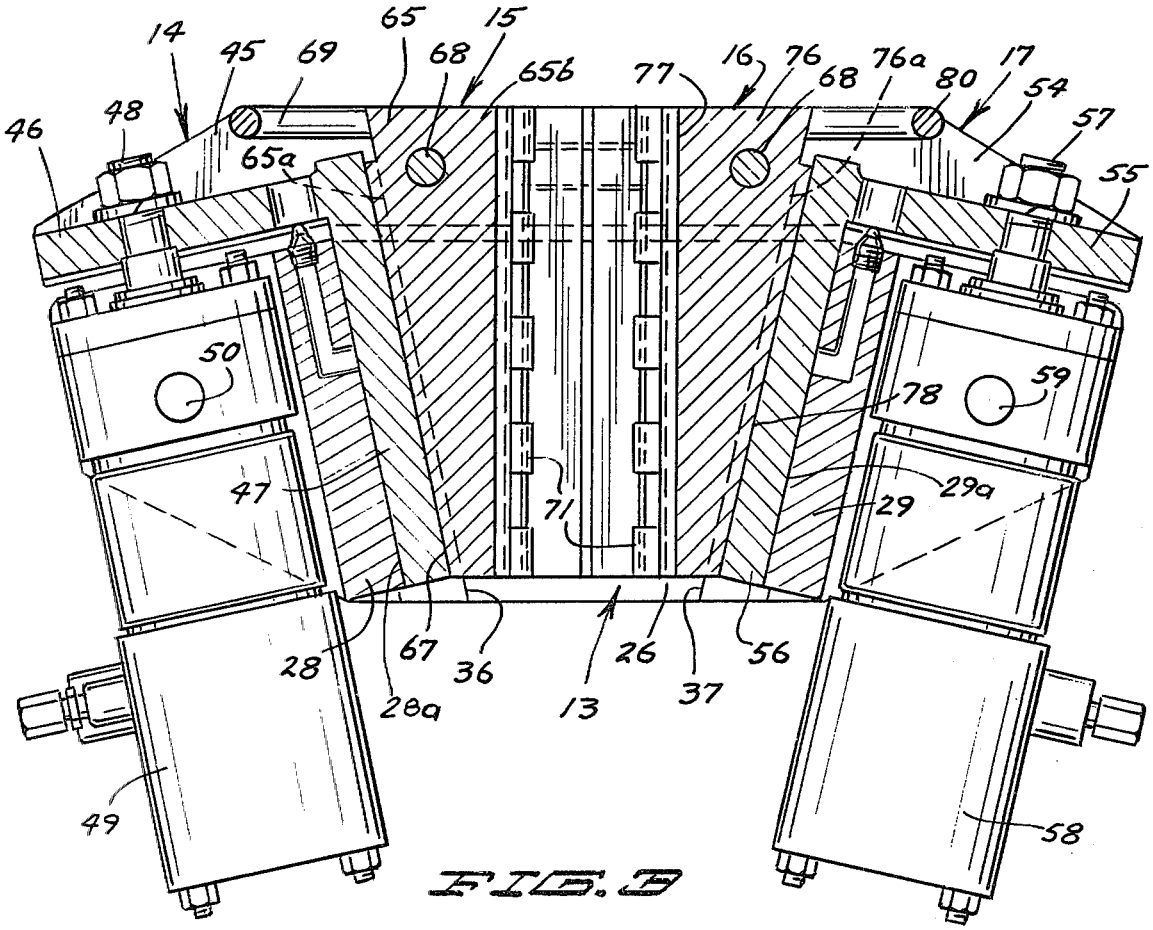
FIG. 3 is a longitudinal cross-sectional view generally taken along the lines and in the direction of the arrows 3—3 of FIG. 2 to show the jaw housing or jaw holder, the jaw actuators, and the jaws.
Figures 2, 7:
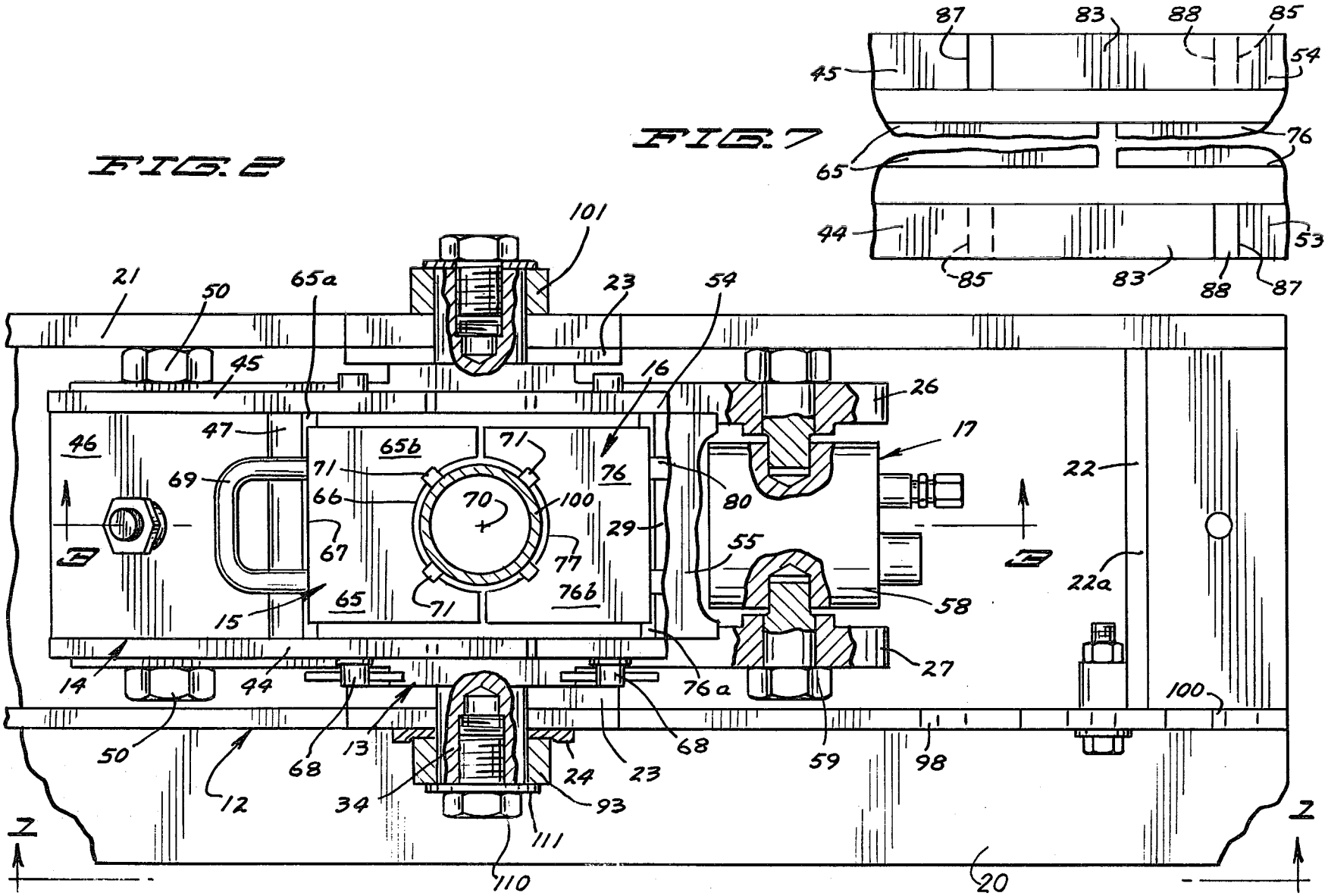
FIG. 2 is a fragmentary plan view generally taken along the line and in the direction of arrows 2—2 of FIG. 1, other than portions of the base, jaw holder and one cylinder are broken away to show the mounting of the trunnions.
FIG. 7 is a fragmentary plan view generally taken along the line and in the direction of arrows 7—7 of FIG. 6 to further illustrate the interlocking features of the jaw actuators.

Referring now in particular to FIGS. 1–3, the apparatus of this invention, generally designated 10, includes a frame (base) 12, a housing or jaw holder 13, a jaw actuator 14, a jaw assembly 15, and a jaw assembly 16, and a jaw actuator 17, all generally designated. The frame 12 is mounted on a suitable platform 18, for example a platform of the drill rig, and includes a right angle side frame member 20, an opposite side frame member 21, and end frame members 22 that extend between and are bolted to the side frame members to bound a generally rectangular space. Spacer plates 23 are mounted on the upper longitudinal central portion of the side frame members while a spacer plate 24 is mounted by frame member 20 on the opposite side thereof from spacer plate 23.

The clamp holder or housing 13 includes longitudinally elongated side plates 26 and 27, the plate 26 having upwardly diverging slots 30, 31 that open toward plate 27. Plate 27 likewise has upwardly diverging slots 32, 33 that open toward slots 30, 31; the slot 32 being transversely opposite 30 and slot 33 being transversely opposite slot 31. Plate 28 extends into slots 30, 32 and is bolted to the side plates while a longitudinally opposite end plate 29 extends into slot 31, 33, and is bolted to the side plates. As may be noted from FIGS. 4 and 5, the end plates are substantially longitudinally spaced from one another and diverge from one another in an upward direction. The longitudinally central upper portion of the side plates 26 and 27 mount trunnions 34 to extend transversely outwardly of one another. The trunnions are pivotally mounted by the side frame members 20, 21 of the frame 12, the trunnions extending through appropriate apertures in the spacer plates 23, 24 to extend transversely outwardly of the vertical leg of the frame member 20 and outwardly of the side frame member 21. Thus, assuming the platform is horizontal, the pivot axis of the trunnions is a horizontal transverse pivot axis.

The side plates 26, 27 and end plates 28, 29 enclose a box-shaped space that in longitudinal vertical cross section is trapezoidal and in horizontal cross section is rectangular. For purposes of convenience, the surfaces of plates 26-29 bounding this space will be referred to as inner surfaces, while the surfaces opposite the inner surfaces will be referred to as outer surfaces.

The plates 26, 27 are provided with transversely opposite slots 36, 38 that open to slots 30, 32 to in part extend longitudinally on the opposite side of the inner surface 28*a* of plate 28 from plate 29 and to open to the aforementioned space. Likewise, transversely opposite slots 37, 39 are formed in side walls 26, 27 to open to space 40 and to extend in part longitudinally on the opposite side of the inner surface 29*a* of plate 29 from plate 28. Slots 36, 38 diverge with reference to slots 37, 39 at substantially the same angles that the end wall mounting slots 30, 32 diverge with reference to slots 31, 33. As in part may be noted from FIGS. 4 and 5, the inclined height of each of the slots 30–33 and 36–39 is substantially greater than the transverse width thereof.

The housing side walls have end portions 26*a*, 27*a* that extend longitudinally away from plate 28 on the side opposite plate 29; and end portions 26*b*, 27*b* that extend away from end plate 29 on the side opposite plate 28. The end portions 26*a*, 27*a* mount trunnions 50 of the jaw actuator 14 for pivotal movement about an axis parallel to the pivot axis of trunnions 34. The trunnions are mounted on opposite sides of the cylinder 49 of the jaw actuator 14, the actuator 14 also including a piston rod 48 secured to the leg 46 of a generally L-shaped bracket 46, 47. Bracket leg (cross guide plate) 47 has transverse opposite end portions extended into slots 36, 38. As may be noted in FIG. 3, leg 46 which extends in overhanding relationship to the top of end plate 28 is joined to the upper end of leg 47 and extends at right angles to leg 47. Thus the axis of movement of the piston rod 48 is substantially parallel to the direction of elongation of slots 36, 38. The bracket leg 46 extends between and is welded to longitudinally elongated side plates 44, 45.

Jaw actuator 17 is of a construction very similar to that of actuator 14 other than for being oppositely faced. That is, actuator 17 includes a piston-cylinder combination 57, 58, transversely oppositely disposed trunnions 59 being provided on the cylinder and extended through apertures in the jaw holders end portions 26*b*, 27*b* to mount cylinder 58 for pivotal movement about a transverse axis that is parallel the pivot axis of trunnions 34. The piston rod 57 is secured to the leg 55 of the right angle bracket 55, 56 to move the bracket therewith while the leg (cross guide plate) 56 has transversely opposite end portions slidably extended in slots 37, 39. Leg 55 extends between and is joined to longitudinally elongated side plates 53, 54 to move these side plates therewith.

To permit the side plates 44, 45 to move longitudinally relatively side plates 54, 53 and to maintain the side plates at substantially the same elevation as the side plates are moved vertically, the side plates are provided with interlocks, see FIGS. 6 and 7. That is, the end portion of wall 44 that is adjacent to wall 53 is provided with a vertically intermediate, generally rectangular cut out 85 that opens toward wall 53, and thus forms upper and lower generally rectangular fingers 83, 84. The end portion of wall 45 that is adjacent to wall 54 is provided with upper and lower, generally rectangular cutouts 87, 89 that open to wall 54 and form a generally rectangular finger 88. Similarly wall 53 is provided with upper and lower generally rectangular cutouts 87, 89 for receiving the fingers 83, 84 of wall 44; and the wall 54 is provided with a vertically intermediate cutout 85 that opens to wall 45 for receiving the finger 88 of wall 45. Due to the fingers extending into the respective cutouts, the movement of the bracket legs 47, 56 toward one another is limited while the bracket legs can move away from one another a preselected distance while preventing one bracket leg and the structure attached thereto to move therewith moving any substantial vertical amount relative the other end bracket leg and the structure attached thereto.

Jaw assembly 15 includes a jaw member 65 that has a pin 68 extended through transverse horizontal apertures in the jaw member and the side walls 44, 45 to be moved vertically and horizontally therewith and at the same time permitting only very limited pivotal movement about the transverse horizontal pin axis. The jaw member 65 is generally of a truncated wedge shape and has an inclined outer wall portion 65*a* that has an outer surface 67 which is inclined at an angle that is equal but opposite to the angle of inclination of the inner surface of leg 47 of the jaw actuator 14. As may be in part noted from FIGS. 2, 3 and 5, the outer wall portion 65*a* has laterally opposite end portions that extend laterally outwardly of the main body portion 65*b* of the jaw members and extend into the respective adjacent slot 36 and 38 to be in abutting slidably relationship with the shoulders of the slots that are remote from but face holder wall 28. The longitudinal dimension of wall 28 is slightly greater than the corresponding dimension of each of slots 30,32, while the combined longitudinal dimensions of leg 47 and jaw wall portion 65*a* is such that the combination 47, 65*a* form a close sliding fit between the inner surface of wall 28 and the shoulder of slot 36 that faces wall 28.

The jaw member 65 has a wall opposite wall portion 65*a* that is generally vertical and has a generally semi-circular cylindrical recess 66 opening toward end wall 29. Mounted on the inner wall portion that defines the semi-cylindrical recess 66 are a plurality of hardened inserts 71. Mounted on the jaw member 65 is a handle 69 to facilitate carrying the jaw member when it it not attached to the jaw actuator 14.

There also is provided a second jaw member 76 (part of jaw assembly 16) that is of substantially the same size and shape as jaw member 65 other than it is oppositely faced from jaw member 65. Thus jaw member 76 has an outer wall portion 76*a* that has end portions extending transversely outwardly of its main body portion 76*b* and into the adjacent one of slots 37, 39 to be in slidably abutting relationship with the shoulders of these slots that are remote from and face holder end wall 29. Further, wall portion 76*a* has an outer, generally planer surface 78 abutting against the inner planar surface of leg 56. Thus jaw member 76 has an outer surface 78 that is upwardly inclined in a direction opposite that of the inner surface of bracket leg 56 to extend parallel thereto and an inner surface that has a circular cylindrical vertical recess 77 opening through the inner wall thereof. The wall portion that defines recess 77 mounts a plurality of hardened inserts 71. When the planar inner surface portions of jaw members 65, 76 abut against one another, the recesses 66, 77 define a circular cylindrical aperture having a central vertical axis 70 (assuming the holder has not been pivoted from the vertical). The handle 80 is attached to jaw member 76 for carrying the jaw member, while there is provided a pin 68 for securing the jaw member 76 to the side walls 53, 54 to move therewith. The apertures for mounting the pin 68 are of slightly larger diameter than the pins to permit limited movement of the jaw members so that substantially the entire outer surfaces of the jaw members can abut against the inner surfaces of the respective bracket legs 47, 56.

The jaws are of a shape to produce suitable jaw loading to resist torque for making and breaking rod joint connections, as well as holding an entire drill string in a hole. On one of the trunnions 34 there is pivotally mounted one end of a radially elongated arm (leg) 93 while on the other trunnion 34 there is pivotally mounted one end of a radially elongated arm 101 that extends parallel to arm 93. The arms 93, 101 may mount other devices which do not form part of this invention but are detailed in co-pending application U.S. Ser. No. 48,489. A lug 94 is welded to arm 93 (or the device mounted thereon) remote from trunnion 34, one end of a turn buckle 96 being pivotally connected by pin 95 to lug 94. Frame member 20 is provided with a plurality longitudinally spaced protusions, three protrusions 98, 99, 100 being illustrated.

Pin 97 attached the adjacent end of turn buckle 96 to the selected one of the protrusions.

In using the apparatus of this invention, the frame is bolted or otherwise appropriately secured to a horizontal platform 18. The apparatus may be used with the trunnions freely pivotal relative to the frame members 20, 21. Alternately with the jaws in an unclamped position and the drill rod extended through recesses 66, 77 and then the jaws moved to their clamped position, the bolts 110 may be tightened to force washers 111 against legs 93, 101 which bear against the frame members to retain the trunnions in a fixed pivotal position relative the frame members that the central axis 70 of the jaw members is coextensive with the central axis of the drill stem. As a result the central axis of the jaw holder will remain coextensive with that of the drill stem until the bolts 110 are loosened.

With fluid under pressure being applied to the lower ends of cylinders 49, 58 the jaw actuator brackets are moved away from the platform 18 and also longitudinally away from one another to a drill rod release position. When fluid under pressure is applied to opposite ends of the cylinders, the actuator brackets move toward one another and also downwardly toward the platform to a drill rod clamping position. The downward motion imparted to the jaws by means of the pin 68 continues until the inserts contact the drill rod. At this time, the drill rod is secured in position both from a torsional and axial movement condition. Further, the jaws are retained in proper position by the cross guide plates 47, 56 respectively that are slidably retained in slots 36, 38 and 37, 39. Since in a clamping position the guide plates are retained in the slots, bending loads imparted from the drill rod to the jaws are not transmitted to the actuating cylinders. To be noted, even though not shown, the cylinders are of a design having a larger piston area on the rod end thereof for reducing a clamping load on the drill rod while the piston end of the cylinders have a smaller area which is not capable of moving the jaws to an unclamping position when the rod weight is hanging in the jaws. This provides a safety feature in that other conventional mechanism has to exert a lifting force on the drill rod prior to the jaws being moved to an unclamp position. Thus, the clamp apparatus of this invention cannot be operated to accidentally release the drill string until such time as other conventional lifting (hoist) mechanism is attached to the drill stem for importing a lifting force thereto, it being noted that the weight of a clamped drill rod acts to move the jaws to exert a greater clamping force. The above features provide a fail-safe condition to prevent dropping of the drill rod down into the hole until a hoist is attached to the rod and the rod is raised to aid and assist the opening movement of the jaws by hydraulic cylinders 49, 58.

Even though the operation of this invention has been described with reference to the jaw axis 70 being vertical, the manner of operation when the axis 70 is inclined relative to the vertical is believed to be apparent.

To be noted is that the jaws can be changed for different rod sizes by removing the pins 68 and then pulling the jaws away from the jaw brackets when the clamp apparatus is in an unclamped position. Additionally, there is provided a suitable clearance that when the jaws are in their unclamp position, there is a radial clearance between the inserts and the drill rod so that drilling can take place without removing the jaws from the jaw actuators. Additionally, due to the interlocking feature of the jaw actuators, the jaws are maintained in proper position of one cylinder to another when operating the apparatus of this invention to a clamped or unclamped position.

What is claimed is:

1. Apparatus for clampingly holding a rod having a central axis of elongation, comprising a base, a first and a second jaw means for cooperatively clampingly engaging a rod, a jaw holder mounting the jaw means for movement between a rod clamping position adjacent the rod axis and a rod release position more remotely spaced from the rod axis and one another and also remotely spaced along said axis from the rod clamping position, power operated means mounted on the jaw holder and connected to the jaw means for moving the jaw means between the rod release position and the rod clamping position, and oppositely disposed trunnions joined to the jaw holder for mounting the jaw holder on the base for pivotal movement about a pivot axis that passes through the central axis and is perpendicular thereto.

2. The apparatus of claim 1 further characterized in that each jaw means includes a jaw and a jaw bracket pivotally mounting the jaw to extend way from the central axis, the power means being connected to the jaw brackets.

3. The apparatus of claim 2 further characterized in that the power means comprises for each bracket a piston cylinder combination having a cylinder pivotally mounted by the jaw holder and an elongated piston rod joined to the respective bracket, the piston rods having axes of elongation that diverge from one another.

4. Apparatus for clamping a rod having a central axis of elongation, comprising a jaw holder having first and second inner surfaces that are opposite one another and diverge from one another in an upward direction, a first and a second bracket having first bracket portions in slidably engagement with the first and second jaw holder surfaces respectively, and second bracket portions joined to the first bracket portions to extend horizontally more longitudinally remote from the respective bracket first portion in a direction away from the other bracket, first and second jaw means mounted on the first and second bracket respectively to move therewith, first and second piston cylinder means connected to the first and second brackets second bracket portions respectively to vertically move the brackets to move the jaw means between a rod release position and a rod clamp position and when moving the brackets to a rod release position, move the brackets horizontally more remote from one another, and means for mounting the piston cylinder means on the jaw holder.

5. The apparatus of claim 4 further characterized in the first jaw means includes a jaw and means for mounting the jaw for pivotal movement on the first bracket in abutable relationship with the first bracket first portion and that the means for mounting the piston cylinder means includes means pivotally mounted on the jaw holder.

6. Apparatus for clampingly holding a rod having a central axis of elongation, comprising a base, a first and a second jaw means for cooperatively clampingly engaging a rod, each jaw means including a jaw and a jaw bracket joined to the jaw to extend away from the central axis, a jaw holder mounting the jaw means for movement between a rod clamping position adjacent the rod axis and a rod release position more remotely spaced from the rod axis and one another and also remotely spaced along said axis from the rod clamping position, power operated means mounted on the jaw holder and connected to the jaw means for moving the jaw means between the rod release position and the rod clamping position, the power means being connected to the jaw brackets and including for each bracket a piston cylinder combination having a cylinder mounted by the jaw holder and an elongated piston rod joined to the respective bracket, the piston rods having axes of elongation that diverge from one another, and oppositely disposed trunnions joined to the jaw holder for mounting the jaw holder on the base for pivotal movement about a pivot axis that passes through the central axis and is perpendicular thereto, the jaw holder including laterally opposite wall portions, each of the wall portions having longitudinally spaced first and second jaw guide slots that are longitudinally between the piston rods and inclined to be substantially parallel to the adjacent piston rod axis, the first and second slots of one side wall portion being generally laterally opposite the edge portions extended into the first slots for slidably movement relative thereto, and the second jaw means having laterally opposite edge portions extended into the second slots for slidable movement relative thereto.

7. The apparatus of claim 6 further characterized in that the first jaw means has laterally spaced slots opening longitudinally to the second jaw means and that the second jaw means has laterally spaced protrusions slidably extended into the first jaw means slots to insure the jaw means moving substantially the same distance as they are moved from their rod release position to their rod clamping position.

8. The apparatus of claim 7 further characterized in that each bracket comprises a plate slidably abutting against the jaw holder, the jaw holder and each bracket plate having cooperating abutting surfaces that are inclined to be substantially parallel to the axis of elongation of the adjacent piston rod and that each jaw means includes means for releasably securing the jaw to the respective bracket, and that each cylinder is pivotally mounted on the jaw holder.

9. The apparatus of claim 6 further characterized in that each jaw means includes a jaw, and a plate mounted on the jaw to move therewith and having laterally opposite edge portions that comprise the edge portions that extend into the respective laterally opposite slots of the jaw holder.

10. Apparatus for clamping a rod having a central axis of elongation, comprising a jaw holder having first and second inner surfaces that are opposite one another, longitudinally spaced from one another and diverge from one another in an upward direction, a first and a second bracket having first bracket portions in slidably engagement with the first and second jaw holder surfaces respectively, and second bracket portions joined to the first bracket portions to extend more longitudinally remote from the respective bracket first portion in a direction away from the other bracket, first and second jaw means mounted on the first and second bracket respectively to move therewith, first and second piston cylinder means connected to the first and second brackets respectively to vertically move the brackets to move the jaw means between a rod release position and a rod clamp position and when moving the brackets to a rod release position, move the brackets horizontally more remote from one another, and means for mounting the piston cylinder means on the jaw holder, the jaw holder having first and second pairs of laterally opposite slots, the first and second slots diverging from one another in an upward direction, the first bracket first portion and the first jaw means having guide parts slidably extended into the first slots and the second bracket first portion and the second jaw means having guide parts slidably extended into the second slots.

11. Apparatus for clamping a rod having a central axis of elongation, comprising a jaw holder having first and second inner surfaces that are opposite one another, longitudinally spaced from one another and diverge from one another in an upward direction, a first and a second bracket having first bracket portions in slidably engagement with the first and second jaw holder surfaces respectively, and second bracket portions joined to the first bracket portions to extend more longitudinally remote from the respective bracket first portion in a direction away from the other bracket, first and second jaw means mounted on the first and second bracket respectively to move therewith, first and second piston cylinder means connected to the first and second brackets respectively to vertically move the brackets to move the jaw means between a rod release position and a rod clamp position and when moving the brackets to a rod release position, move the brackets horizontally more remote from one another, means for mounting the piston cylinder means on the jaw holder, and a base, the jaw holder having laterally opposite trunnions pivotally mounted by the base, and the means for mounting the piston cylinder means including longitudinally spaced pivot means having parallel lateral pivot axes for pivotally mounting the first and second piston cylinder means in longitudinal spaced relationship to one another.

12. Apparatus for clamping a rod having a central axis of elongation, comprising a jaw holder having first and second inner surfaces that are opposite one another, longitudinally spaced from one another and diverge from one another in an upward direction, a first and a second bracket having first bracket portions in slidably engagement with the first and second jaw holder surfaces respectively, and second bracket portions joined to the first bracket portions to extend more longitudinally remote from the respective bracket first portion in a direction away from the other bracket, first and second jaw means mounted on the first and second bracket respectively to move therewith, first and second piston cylinder means connected to the first and second brackets respectively to vertically move the brackets to move the jaw means between a rod release position and a rod clamp position and when moving the brackets to a rod release position, move the brackets horizontally more remote from one another, and means for mounting the piston cylinder means on the jaw holder, the first jaw means having laterally spaced longitudinal slots that open toward the second jaw means and the second jaw means having laterally spaced longitudinally extending protrusions slidably extended into the first jaw means slot.

* * * * *